US006960731B2

(12) United States Patent
Azzola et al.

(10) Patent No.: US 6,960,731 B2
(45) Date of Patent: Nov. 1, 2005

(54) CONTACT SUPPORTING SHAFT FOR A LOW-VOLTAGE POWER CIRCUIT BREAKER

(75) Inventors: Lucio Azzola, Bergamo (IT); Eligio Zanchi, Alzano Lombardo (IT)

(73) Assignee: ABB Services S.r.l., Milan (IT)

( * ) Notice: Subject to any disclaimer, the term of this patent is extended or adjusted under 35 U.S.C. 154(b) by 31 days.

(21) Appl. No.: 10/496,575

(22) PCT Filed: Dec. 10, 2002

(86) PCT No.: PCT/EP02/14072

§ 371 (c)(1),
(2), (4) Date: May 24, 2004

(87) PCT Pub. No.: WO03/050830

PCT Pub. Date: Jun. 19, 2003

(65) Prior Publication Data

US 2004/0256207 A1 Dec. 23, 2004

(30) Foreign Application Priority Data

Dec. 10, 2001 (IT) ..... MI2001A2587

(51) Int. Cl.[7] ..... H01H 1/22

(52) U.S. Cl. ..... 200/244; 200/47; 338/8; 338/9

(58) Field of Search ..... 335/8, 9, 10

(56) References Cited

U.S. PATENT DOCUMENTS 3,958,095 A * 5/1976 Zaffrann et al. ..... 200/293
4,166,988 A * 9/1979 Ciarcia et al. ..... 335/9
5,025,236 A * 6/1991 Miura et al. ..... 335/46
5,262,744 A 11/1993 Arnold et al.
5,686,709 A * 11/1997 Casagrande et al. ..... 200/50.32
5,926,081 A * 7/1999 DiMarco et al. ..... 335/16
6,259,338 B1 7/2001 Boeder et al.
6,437,269 B1 * 8/2002 Rakus ..... 200/400

FOREIGN PATENT DOCUMENTS

JP 2000113798 4/2000

* cited by examiner

*Primary Examiner*—K. Richard Lee
(74) *Attorney, Agent, or Firm*—Connoll Bove Lodge & Hutz LLP; Myron K. Wyche

(57) ABSTRACT

A rotating contact supporting shaft for a low-voltage power circuit breaker, whose particularity consists of the fact that it has a modular structure that comprises, along the rotation axis, at least one first and one second supporting module (10, 20), each module being functionally coupled to at least one corresponding moving contact (3) of the circuit breaker and being provided respectively with first and second means (22) for connection to at least one first interconnection module (30); the first interconnection module is interposed between the first and second supporting modules and is provided with third and fourth connection means (31) that are suitable to be coupled respectively to the first and second connection means; the coupling between the first and third connection means and between the second and fourth connection means allows the functional connection between the first and second supporting modules and the direct structural connection of the interconnection module to the first and second supporting modules.

29 Claims, 4 Drawing Sheets

CONTACT SUPPORTING SHAFT FOR A LOW-VOLTAGE POWER CIRCUIT BREAKER

DESCRIPTION

The present invention relates to a contact supporting shaft for a low-voltage power circuit breaker, i.e., for operating voltages up to 1000 volts, having improved characteristics.

It is known that low-voltage power circuit breakers are protection devices used generally in industrial electrical systems characterized by operating voltages up to 1000 volts and by electric currents of relatively high nominal value, which produce correspondingly high power levels.

Said power circuit breakers comprise one or more electric poles, whose number determines their designation in practice as single-pole, two-pole, three-pole circuit breakers and so forth; in turn, each electric pole comprises at least two contacts, a fixed contact and a moving contact, which can be mutually coupled/uncoupled and are electrically connected to the phase or neutral conductor associated with said electric pole. Generally, the moving contacts of each pole of the circuit breaker are mounted on a rotating contact supporting shaft that is connected mechanically to the actuation mechanism of said circuit breaker, for example a spring-type kinematic system, and allows to transmit the motion among the various poles.

In the current art, the methods for manufacturing the contact supporting shafts of the known type and their practical use, while allowing to perform adequately the required functions, have drawbacks and critical aspects.

In particular, a first known type of solution provides the contact supporting shafts monolithically, and this complicates the steps of the assembly of the circuit breaker and most of all maintenance operations during practical use. In case of a maintenance intervention on a single pole, it is in fact necessary to disassemble completely all the poles. Moreover, with this solution it is necessary to produce multiple series of shafts of different sizes according to the number of poles used in the circuit breaker and to the size of said circuit breakers. All this clearly has a negative impact on manufacturing costs and on the maintenance and operating costs of the circuit breakers.

A second solution used in practice instead entails providing the contact supporting shaft by means of a modular structure. In this case, the shaft is constituted by multiple structurally separate elements or modules, which are mutually assembled by means of additional through interconnection components, such as bars or tension elements; these through components pass through the various modules along the entire length of the shaft, so as to allow their mutual assembly and allow to transmit motion among the various poles of the circuit breaker. With this solution, one of the most critical aspects is the difficulty in uniform transmission of motion along the entire shaft, since during the operating life of the circuit breaker the through elements can be subject to deteriorations and separations of the parts to which they are connected, for example due to the considerable torsional stresses and to the vibrations to which said shaft is normally subjected during the switching operations of the circuit breaker, or in case of tripping or short circuit. The operating efficiency of the circuit breaker, however, depends on the perfect state of preservation of the shaft. Accordingly, very often it is necessary to perform difficult and expensive maintenance operations in order to ensure adequate reliability or even replace the shaft. These critical aspects are particularly demanding in the case of a circuit breaker with more than three poles, since in view of the relatively great length of the through interconnection elements with respect to the dimensions of the modules associated with the various poles, torsion phenomena affecting the poles located at the ends of the shaft are significant and cause a delay in the movement of the moving contact of these poles with respect to the inner ones that lie closer to the actuation system. In order to obviate this drawback, in addition to maintenance interventions it is usually necessary to act during manufacturing so as to compensate the moving contacts of said outer poles with an angle that provides earlier tripping than the others and therefore prevent or limit the delay caused by torsion phenomena occurring during operation.

In any case, the use of the tension elements or bars for assembly increases considerably the number of required constructive components, bearing also in mind that they must be differentiated appropriately according to the size and the number of poles of the circuit breaker in which they are to be used; finally, the fact should not be dismissed that this solution in any case entails an increase in the complexity of the operations for assembling/disassembling said components. These aspects of course have negative repercussions on the overall manufacturing costs and on the costs of the use and maintenance of the circuit breakers.

The aim of the present invention is to provide a rotating contact supporting shaft for a low-voltage power circuit breaker that allows to overcome the drawbacks described above and in particular, with respect to known shaft types, has an optimized constructive structure and functional performance.

Within the scope of this aim, an object of the present invention is to provide a rotating contact supporting shaft for a low-voltage power circuit breaker that, with respect to known types of shaft, allows to eliminate completely, or at least reduce significantly, any non-uniformities in the transmission of motion among the various poles of the circuit breaker.

Another object of the present invention is to provide a rotating contact supporting shaft for a low-voltage power circuit breaker that with respect to known shaft types allows to reduce the number of constructive components required as a function of the number of poles and of the size of the circuit breaker in which it is used.

Another object of the present invention is to provide a rotating contact supporting shaft for a low-voltage power circuit breaker that is set up in a simplified manner with respect to the known art, avoiding complicated joining and assembly operations.

Another object of the present invention is to provide a rotating contact supporting shaft for a low-voltage power circuit breaker that allows to reduce production costs and the maintenance interventions required during the useful life of the circuit breaker.

Another object of the present invention is to provide a rotating contact supporting shaft for a low-voltage power circuit breaker that can be manufactured easily and at a modest cost and with high reliability.

This aim, these objects and others that will become better apparent hereinafter are achieved by a rotating contact supporting shaft for a low-voltage power circuit breaker, characterized in that it has a modular structure that comprises, along the rotation axis, at least one first and one second supporting module, each module being functionally coupled to at least one corresponding moving contact of the circuit breaker and being provided respectively with first and second means for connection to at least one first interconnection module, said first interconnection module being interposed between said first and second supporting modules and being provided with third and fourth connection means that are suitable to be coupled respectively to said first and second connection means, the coupling between said first and third connection means and between said second and fourth connection means allowing the functional connection between said first and second supporting modules and the direct structural connection of said interconnection module to said first and second supporting modules.

In this manner, with respect to the known art the contact supporting shaft according to the invention advantageously has a modular structure with a reduced number of components and in which the coupling among the various parts that constitute the shaft occurs in a direct manner, according to a constructive solution that is extremely simplified and at the same time functionally very effective.

Further characteristics and advantages will become apparent from the description of preferred but not exclusive embodiments of the contact supporting shaft according to the present invention, illustrated only by way of non-limitative example in the accompanying drawings, wherein.

Figure 3:
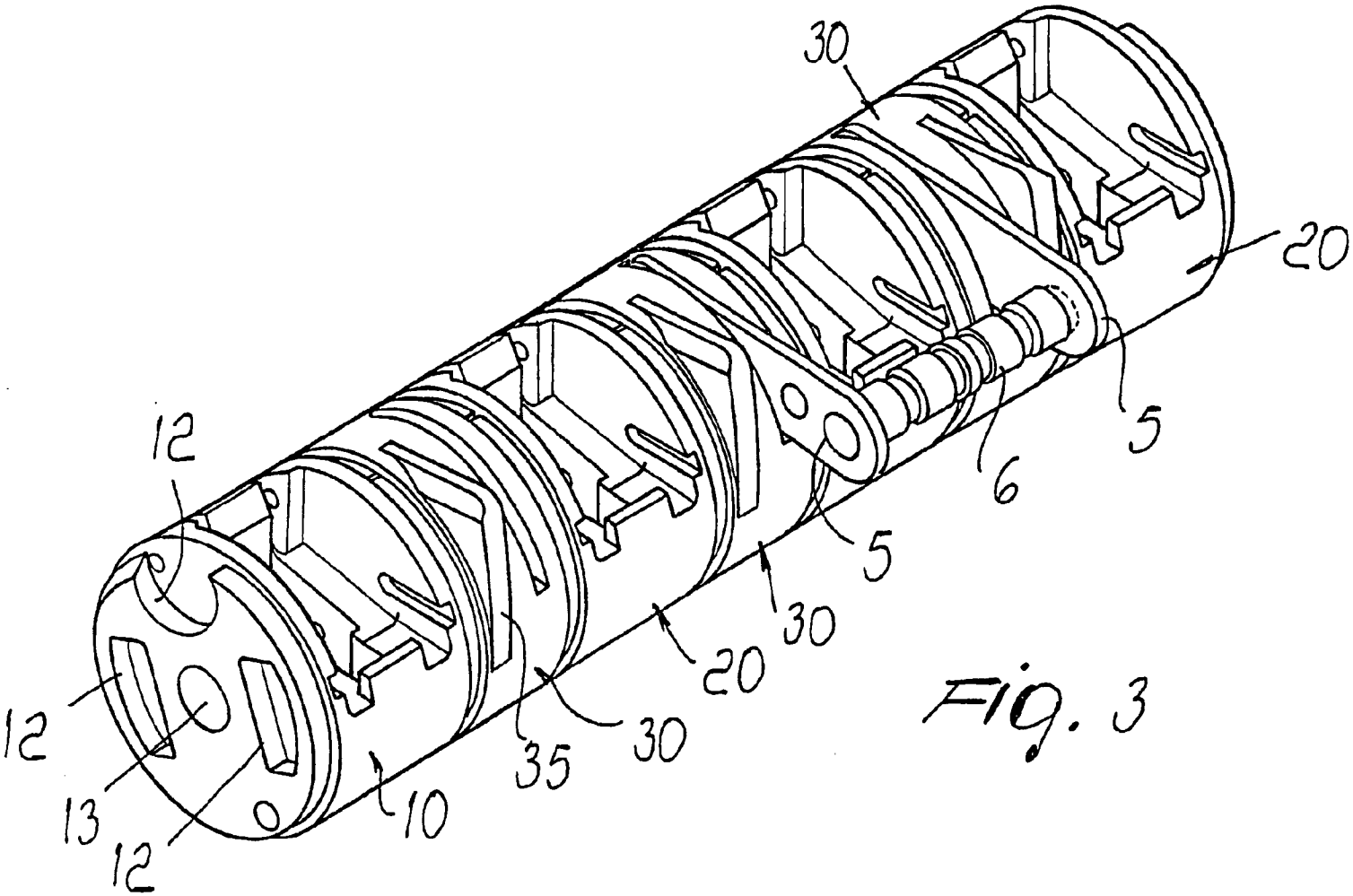
Figure 4:
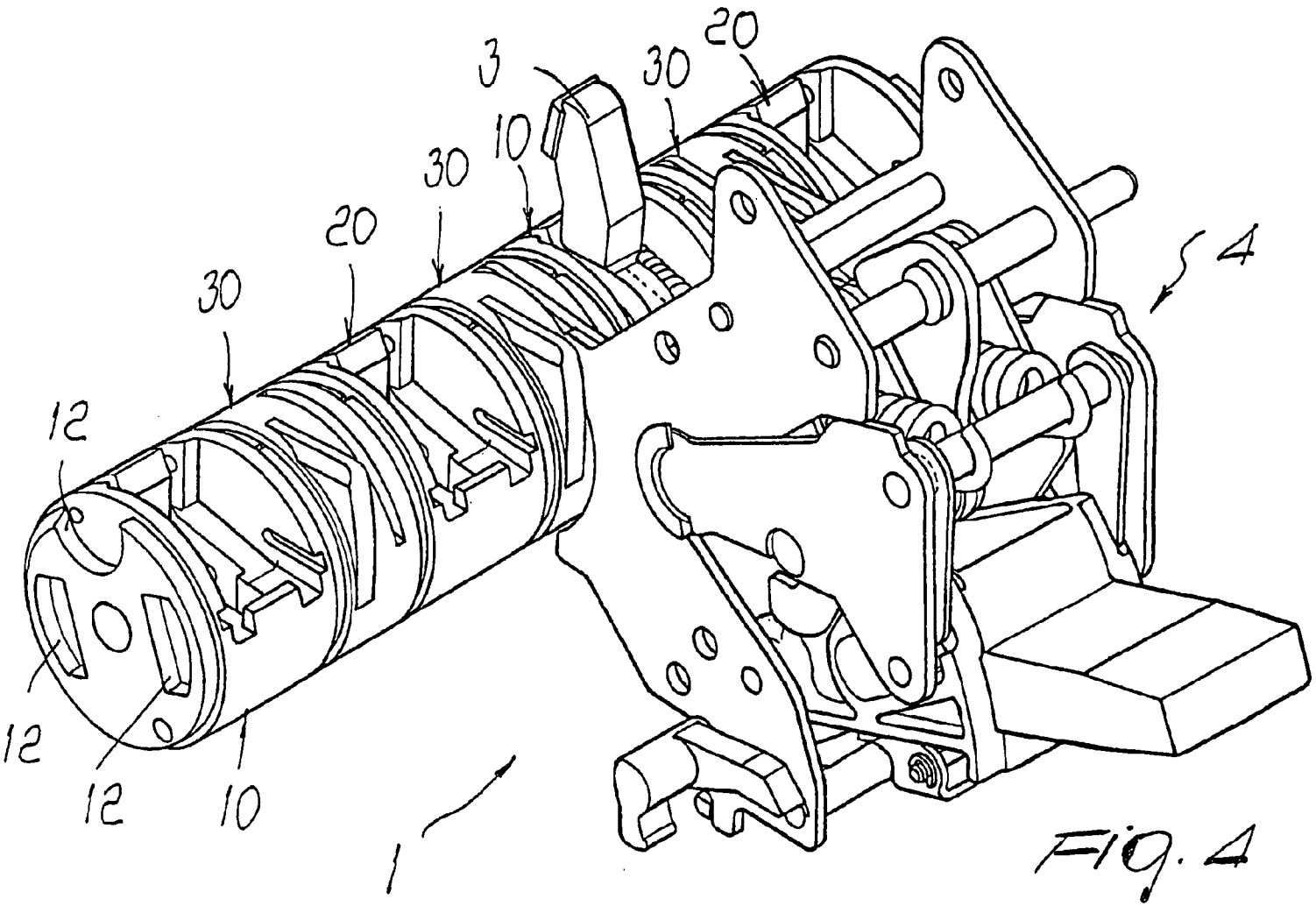

FIG. 3 is a perspective view of a shaft according to the invention for a four-pole power circuit breaker, with the modules assembled and coupled with connecting linkages of the actuation mechanism of the circuit breaker; and FIG. 4 is a perspective view of the contact supporting shaft of FIG. 3, connected to the actuation mechanism of said circuit breaker, illustrating by way of example one of the moving contacts.

With reference to the cited figures, the rotating contact supporting shaft according to the invention, generally designated by the reference numeral 1, has a modular structure that comprises, along the rotation axis 2 of said shaft, at least one first supporting module 10 and one second supporting module 20, each functionally coupled to a corresponding moving contact of a pole of the circuit breaker in which the shaft is to be used, so as to support it structurally and allow its necessary movement. In particular, in the illustrated embodiment, both the first supporting module 10 and the second supporting module 20 preferably have a substantially cylindrical body that is contoured so as to form a seat, designated by the reference numerals 11 and 21 respectively, that is open along the lateral surface of said cylindrical body. According to various embodiments that are widely known in the art and therefore not described herein in detail, each one of said seats 11 and 21 conveniently accommodates the moving contact of the pole with which each supporting module is associated; an example in this regard is shown schematically in FIG. 4, which partially illustrates the structure of a single moving contact, designated by the reference numeral 3. Advantageously, in the embodiment of the shaft according to the invention, the first supporting module 10 and the second supporting module 20 respectively comprise first and second means for connection to at least one first interconnection module 30, for the purposes and in the manners that will become better apparent hereinafter.

Figure 1:
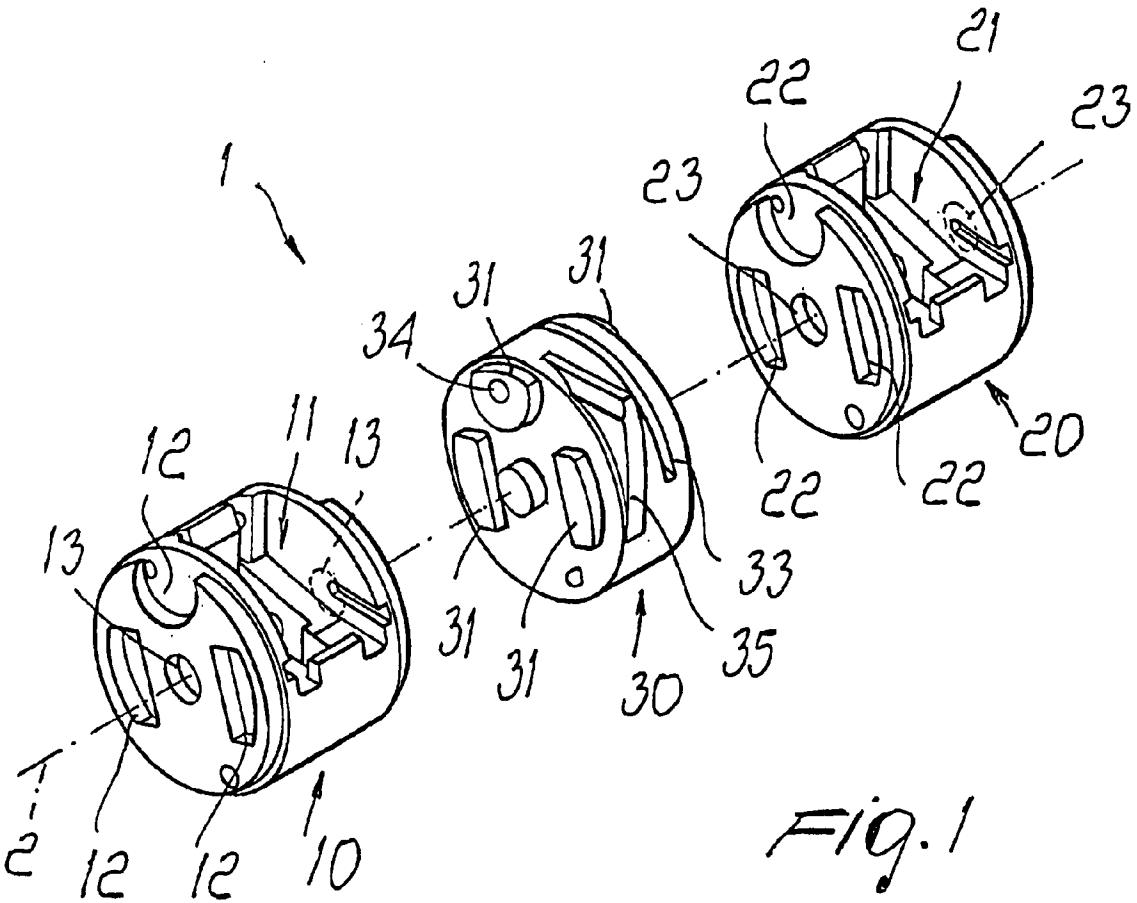
FIG. 1 is an exploded perspective view of two supporting modules and of an interconnection module used in a contact supporting shaft according to the invention, for a circuit breaker of the two-pole type.
Figure 2:
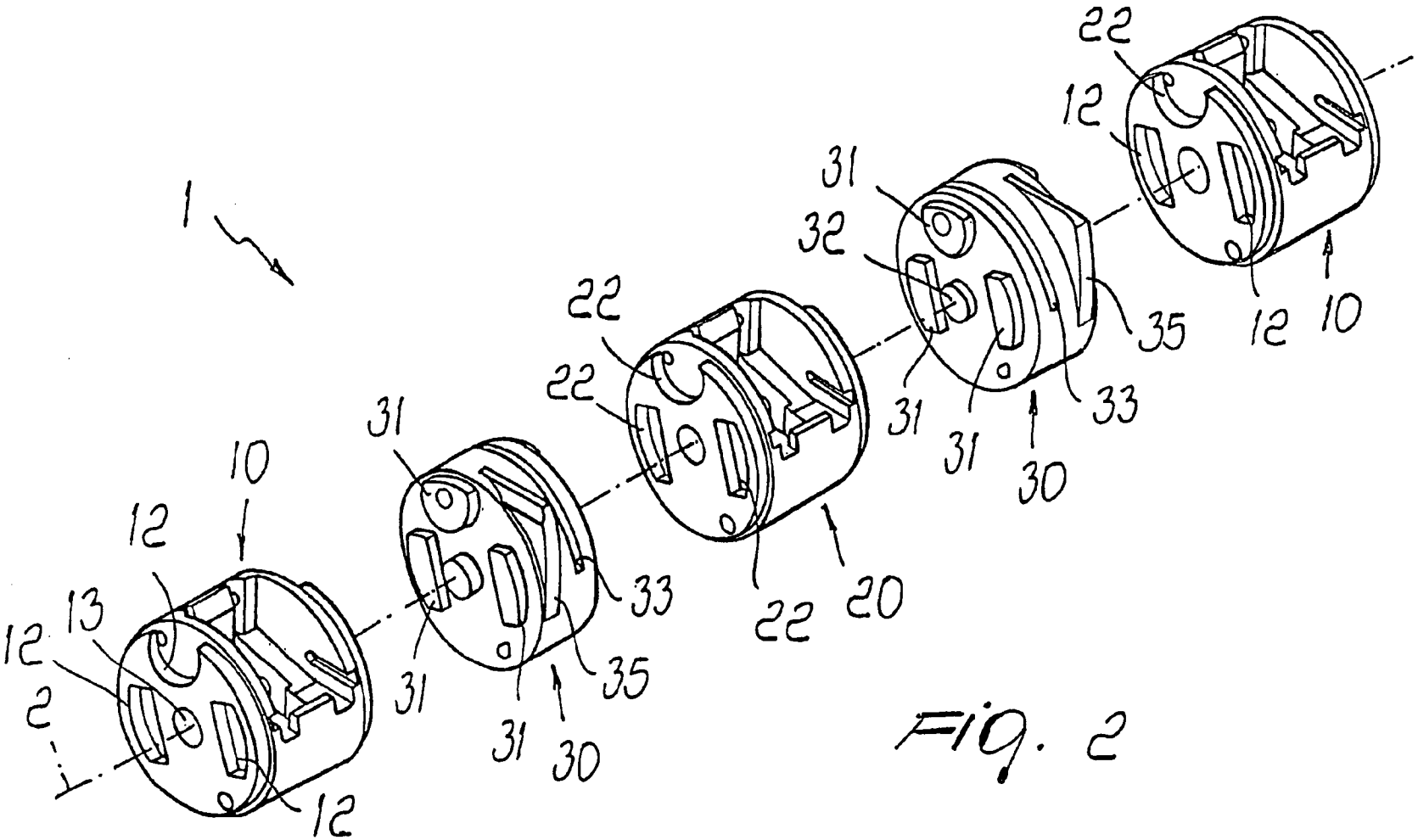
FIG. 2 is an exploded perspective view of the modules that compose a contact supporting shaft according to the invention, usable in a three-pole power circuit breaker.

As shown in detail in FIG. 1, the interconnection module 30 also preferably has a substantially cylindrical body that is contoured so as to have third and fourth connection means that allow connection to the two supporting modules 10 and 20; in particular, during the assembly of the shaft, the interconnection module 30 is arranged along the axis 2, interposed between the two supporting modules 10 and 20, so that the third connection means are coupled to the first connection means formed on the first supporting module 10, and so that the fourth connection means are coupled to the second connection means formed on the second supporting module 20. In this manner, the module 30 functionally interconnects the two supporting modules 10 and 20 arranged on its sides and is directly connected to them structurally. Preferably, in the contact supporting shaft according to the invention, the coupling between the first and third connection means and between the second and fourth connection means is of the male-female type.

In the illustrated embodiment, the first connection means formed on the module 10 and the second connection means formed on the module 20 comprise at least one seat, designated by the reference numerals 12 and 22 respectively, that is formed on at least one of the end faces of the corresponding cylindrical body. Preferably, as shown in detail in FIG. 1, the first and second connection means comprise at least three seats, designated by the reference numerals 12 and 22 respectively, that are arranged on at least one of the two end faces of the corresponding cylindrical body: two of said seats are arranged substantially symmetrically to each other with respect to the rotation axis 2, and a third seat is arranged proximate to an edge of the corresponding end face. More preferably, the first and second connection means both comprise two sets of three receptacles 12 and 22 (only one of which for each module is visible in the figures), each set of three being arranged on a corresponding end face of the corresponding cylindrical body and having two seats that are arranged substantially symmetrically to each other with respect to the rotation axis 2 and a third seat that is arranged proximate to an edge of said end face.

In turn, the third and fourth connection means are formed respectively on the two opposite end faces of the cylindrical body of the interconnection module 30 and comprise at least one tooth that protrudes transversely from the respective end face and is suitable to enter a corresponding receptacle 12 or 22. Preferably, both the third connection means and the fourth connection means comprise three teeth 31 that are shaped geometrically complementarily to the respective receptacles: two of said teeth 31 are arranged, on the two end faces of the cylindrical body, substantially symmetrically to each other relative to the rotation axis 2, and the third tooth 31 is arranged proximate to an edge of the end face; said teeth 31, during assembly, are inserted with an interlocking action in a corresponding receptacle 12 and 22. Furthermore, two pivots 32 (only one of which is visible in FIG. 1) are formed on the two end faces of the cylindrical body of the interconnection module 30 in a substantially central position; said pivots protrude in mutually opposite directions along the rotation axis 2 and are suitable to be inserted in two corresponding dead holes 13 and 23, formed respectively in the first and second supporting modules 10 and 20 so as to facilitate the correct mutual centering of said modules.

Finally, in the shaft according to the invention the body of the interconnection module 30 is conveniently shaped so as to comprise means for interacting with elements for indicating the state of the circuit breaker and means for coupling to a mechanism for the actuation of said circuit breaker; an example of actuation mechanism of the circuit breaker, of the spring-operated type, is shown in FIG. 4 and is generally designated by the reference numeral 4.

In the specific case, the means for coupling to the mechanism 4 for the actuation of the circuit breaker comprise at least one slot 33, which is formed in the lateral surface of the cylindrical body that is interposed between the two teeth 31 arranged at the edges of the end faces. The slot 33 and the two teeth 31 that flank it are crossed by a through hole 34, which is suitable to receive a pivot for connection to the actuation mechanism 4. For example as shown in FIG. 3, in the case of a four-pole circuit breaker there are two interconnection modules 30, each connected to a linkage 5, the two linkages being mutually connected by an additional connecting element 6. Clearly, many other coupling solutions that are functionally equivalent to the one described above are possible.

In turn, the means for interacting with elements for indicating the state of the circuit breaker comprise a triangular tab 35 which, when the circuit breaker is operated and therefore the shaft 1 turns, interacts with said elements and causes them to indicate the open/closed or released state of said circuit breaker.

In practice it has been found that the contact supporting shaft according to the invention allows to achieve fully the intended aim and objects, providing a significant series of advantages with respect to the known art. As described above, the shaft 1 in fact has a modular structure in which the component modules, by virtue of their innovative structure, and particularly by virtue of the adoption of the respective connection means, are structurally connected to each other directly without resorting to additional connection elements, such as through shafts or tension elements, consequently reducing the manufacturing costs and simplifying the management of inventory reserves and codes. Furthermore, the adoption of the direct coupling system, particularly of the male-female type, allows to simplify considerably the operations for assembling/disassembling the shaft and to obtain a mechanical connection among the various modules that is simpler, more reliable and functionally much more effective than known types of solution. A direct interlocking coupling is in fact provided between each interconnection module and the two corresponding supporting modules in which the respective connection means not only allow to connect the various parts directly and establish a monolithic coupling among the modules, but most of all by virtue of the geometric coupling of the surfaces of the teeth with the respective seats they act as motion transmission elements, facilitating the substantially simultaneous movement of the interconnection modules and of the supporting modules with the corresponding moving contacts 3 supported thereby during a rotation of the shaft.

In this manner, the structure of the shaft according to the invention combined the advantages of precision and simultaneous movement that are typical of monolithic shafts with the advantages of modular structures, eliminating the drawbacks due to the presence of additional through interconnection elements, particularly the negative effects of torsional stresses. Accordingly, this allows to improve the reliability, economy and ease of use of the circuit breaker, since maintenance interventions are reduced and the corrective constructive refinements required for circuit breakers with more than three poles are rendered unnecessary.

The fact should also not be neglected that the shaft according to the invention has a modular structure that has a very high degree of modularity that makes it usable in all automatic low-voltage power circuit breakers, be they of the type with two, three or more poles, of the standard, current-limiting type, with poles having single or double moving contacts; in such cases, as shown for example in FIGS. 3 and 4, it is in fact sufficient to use, for each additional pole, a corresponding supporting module that is connected to the supporting module of the moving contact of the adjacent pole by an additional interconnection module, in a manner that is fully similar to what has been described above. Accordingly, the present invention also relates to a low-voltage power circuit breaker, characterized in that it comprises a contact supporting shaft according to what has been described above.

Finally, the advantages from the point of view of manufacture are further increased by the fact that the supporting modules are all mutually identical and, with respect to a central plane that is perpendicular to the axis of their cylindrical body, have a substantially symmetrical structure; likewise, the interconnection modules 30 also have fully mutually identical configurations of the two end faces with the corresponding teeth. Accordingly, this allows to simplify the number of elements to be produced as a function of the number of poles of the circuit breaker and of the sizes; furthermore, assembly is simplified considerably, since each supporting module can be installed equally on one or both sides and the modules can be swapped without any problem and very simply. Finally, the interconnection module also is particularly interchangeable.

The contact supporting shaft for a low-voltage power circuit breaker thus conceived is susceptible of numerous modifications and variations, all of which are within the scope of the inventive concept. For example, one might use configurations in which the receptacles are formed in the interconnection module 30 and the teeth are provided on the supporting modules, or use a different number of teeth and corresponding receptacles, or modify the shape and position of the teeth and the receptacles on the end faces of the corresponding cylindrical bodies, or adopt another type of male-female connection, for example with systems for the direct screw coupling of the modules, or any other solution, so long as it is compatible with the purpose of the invention. In practice, the materials used, so long as they are compatible with the specific use, as well as the dimensions, may be any according to the requirements and the state of the art.

What is claimed is:

1. A rotating contact supporting shaft for a low-voltage power circuit breaker, having a modular structure that comprises, along the rotation axis, at least one first and one second supporting module, each module being functionally coupled to at least one corresponding moving contact of the circuit breaker and being provided respectively with first and second means for connection to at least one first interconnection module, said first interconnection module being interposed between said first and second supporting modules and being provided with third and fourth connection means that are suitable to be coupled respectively to said first and second connection means, the coupling between said first and third connection means and between said second and fourth connection means allowing the functional connection between said first and second supporting modules and the direct structural connection of said interconnection module to said first and second supporting modules, wherein said first and second supporting modules have a substantially cylindrical body and said first and second connection means comprise three receptacles arranged on at least one of the two end faces of the corresponding cylindrical body, two of said receptacles being arranged substantially symmetrically with respect to each other relative to the rotation axis, a third receptacle being arranged proximate to an edge of the corresponding end face.

2. The contact supporting shaft according to claim 1, wherein said first and second connection means comprise two sets of three receptacles, each set being arranged on a corresponding end face of the corresponding cylindrical body and having two receptacles that are arranged substantially symmetrically with respect to each other relative to the rotation axis and a third receptacles that is arranged proximate to an edge of said end face.

3. The contact supporting shaft according to claim 1 or 2, wherein said interconnection module has a substantially cylindrical body, said third and fourth connection means being formed respectively an the two end faces of said cylindrical body and comprising at least one tooth that is suitable to enter a corresponding receptacle formed in said first and second supporting modules.

4. The contact supporting shaft according to claim 3, wherein said third and forth connection means comprise three teeth, two of said teeth being arranged on the respective end faces of the cylindrical body aid being substantially symmetrical with respect to each other relative to the rotation axis, a third tooth being arranged proximate to an edge of the respective end face, said teeth being suitable to enter the corresponding receptacles formed in said first and second supporting modules.

5. The contact supporting shaft according to claim 3, wherein on the two end faces of the cylindrical body of the interconnection module, and in a substantially central position, there are also two corresponding pivots that protrude in mutually opposite directions along the rotation axis of the shaft and are suitable to be inserted in two corresponding dead holes formed respectively in the first and second supporting modules.

6. The contact supporting shaft according to claim 1, wherein said interconnection module comprises means for coupling to a circuit breaker actuation mechanism and means for interaction with elements for indicating the state of the circuit breaker.

7. The contact supporting shalt according to claim 6, wherein said means for coupling to an actuation mechanism of the circuit breaker comprise a slot formed in the lateral surface of said cylindrical body with the third teeth arranged on its sides, the slot and the teeth that flank it being crossed by a through hole that is suitable to receive a pivot for connection to said actuation mechanism of the circuit breaker.

8. The contact supporting shaft according to claim 6, wherein said means for interaction with the elements for indicating the state of the circuit breaker comprise a tab that protrudes from the lateral surface of the cylindrical body transversely to the rotation axis.

9. The contact supporting shaft according to claim 1, wherein said first and third connection means and said second and fourth connection means are mutually coupled so as to facilitate a substantially simultaneous movement of said first and second supporting modules and said interconnection module during a rotation of the shaft.

10. The contact supporting shaft according to claim 1, wherein the coupling between said first and third connection means and between said second and fourth connection means is of the male-female type.

11. The contact supporting shaft according to claim 1, wherein said first and second connection means are coupled with an interlocking action respectively to said third and fourth connection means.

12. A rotating contact supporting shaft for a low-voltage power circuit breaker, having a modular structure that comprises, along the rotation axis, at least one first and one second supporting module, each module being functionally coupled to at least one corresponding moving contact of the circuit breaker and being provided respectively with first and second means for connection to at least one first interconnection module, said first interconnection module being interposed between said first and second supporting modules and being provided with third and fourth connection means that are suitable to be coupled respectively to said first and second connection means, the coupling between said first and third connection means and between said second and fourth connection means allowing the functional connection between said first and second supporting modules and the direct structural connection of said interconnection module to said first and second supporting modules, wherein said interconnection module has a substantially cylindrical body, on the two end faces of the cylindrical body of the interconnection module, and in a substantially central position, there being two corresponding pivots that protrude in mutually opposite directions along the rotation axis of the shall and are suitable to be inserted in two corresponding dead holes formed respectively in the first and second supporting modules.

13. The contact supporting shaft according to claim 12, wherein said first and second supporting modules have a substantially cylindrical body and wherein said first and second connection means also comprise at least one seat formed in at least one of the end faces of the respective cylindrical body.

14. The contact supporting shaft according to claim 12 or 13, wherein said first and third connection means and said second and fourth connection means are mutually coupled so as to facilitate a substantially simultaneous movement of said first and second supporting modules and said interconnection module dining a rotation of the shaft.

15. The contact supporting shaft according to claim 12 or 13, wherein the coupling between said first and third connection means and between said second and fourth connection means is of the male-female type.

16. The contact supporting shaft according to claim 12 or 13, wherein said first and second connection means are coupled with an interlocking action respectively to said third and fourth connection means.

17. The contact supporting shaft according to claim 12, wherein said interconnection module comprises means for coupling to a circuit breaker actuation mechanism and means for interaction with elements for indicating the state of the circuit breaker.

18. The contact supporting shaft according to claim 17, wherein said means for interaction with the elements for indicating the state of the circuit breaker comprise a tab that protrudes from the lateral surface of the cylindrical body transversely to the rotation axis.

19. The contact supporting shaft according claim 17, wherein said first and second supporting modules have a substantially cylindrical body and said first and second connection means comprise three receptacles arranged on at least one of the two end faces of the corresponding cylindrical body, two of said receptacles being arranged substantially symmetrically with respect to each other relative to the rotation axis, a third receptacle being arranged proximate to an edge of the corresponding end face, and wherein said third and fourth connection means comprise three teeth, two of said teeth being arranged on the respective end faces of the cylindrical body and being substantially symmetrical with respect to each other relative to the rotation axis, a third tooth being arranged proximate to an edge of the respective end face, said teeth being suitable to enter the corresponding receptacles formed in said first and second supporting modules.

20. The contact supporting shaft according to claim 19, wherein said means for coupling to an actuation mechanism of the circuit breaker comprise a slot formed in the lateral surface of said cylindrical body with the third teeth arranged on its sides, the slot and the teeth that flank it being crossed by a through hole that is suitable to receive a pivot for connection to said actuation mechanism of the circuit breaker.

21. A rotating contact supporting shaft for a low-voltage power circuit breaker, having a modular structure that comprises, along the rotation axis, at least one first and one second supporting module, each module being functionally coupled to at least one corresponding moving contact of the circuit breaker and being provided respectively with first and second means for connection to at least one first interconnection module, said first interconnection module being interposed between said first and second supporting modules and being provided with third and fourth connection means that are suitable to be coupled respectively to said first and second connection means, the coupling between said first and third connection means and between said second and fourth connection means allowing the functional connection between said first and second supporting modules and the direct structural connection of said interconnection module to said first and second supporting modules, wherein said interconnection module has a substantially cylindrical body, said third and fourth connection means being formed respectively on the two end faces of said cylindrical body.

22. The contact supporting shaft according to claim 21, wherein said first and third connection means and said second and fourth connection means are mutually coupled to as to facilitate a substantially simultaneous movement of said first and second supporting modules and said interconnection module during a rotation of the shaft.

23. The contact supporting shaft according to claim 21 or 22, wherein the coupling between said first and third connection means and between said second and fourth connection means is of the male-female type.

24. The contact supporting shaft according to claim 23, wherein said first and second connection means are coupled with an interlocking action respectively to said third and fourth connection means.

25. The contact supporting shaft according to claim 21, wherein said first and second supporting modules have a substantially cylindrical body, said first and second connection means comprising at least one seat formed in at least one of the end faces of the respective cylindrical body.

26. The contact supporting shaft according to claim 21, wherein said third and fourth connection means comprise at least one tooth that is suitable to enter a corresponding receptacle formed in said first and second supporting modules.

27. The contact supporting shaft according to claim 21, wherein said interconnection module comprises means for coupling to a circuit breaker actuation mechanism and means for interaction with elements for indicating the state of the circuit breaker.

28. The contact supporting shaft according to claim 27, wherein said means for interaction with the elements for indicating the state of the circuit breaker comprise a tab that protrudes from the lateral surface of the cylindrical body transversely to the rotation axis.

29. A low-voltage power circuit breaker comprising a contact supporting shaft according to claim 1 or 12 or 21.

* * * * *